US008567187B2

(12) United States Patent
Nakamura

(10) Patent No.: US 8,567,187 B2
(45) Date of Patent: Oct. 29, 2013

(54) THERMOACOUSTIC ENGINE

(75) Inventor: Haruo Nakamura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 188 days.

(21) Appl. No.: 13/092,732

(22) Filed: Apr. 22, 2011

(65) Prior Publication Data

US 2011/0259000 A1 Oct. 27, 2011

(30) Foreign Application Priority Data

Apr. 23, 2010 (JP) ..... P2010-099823

(51) Int. Cl.
*F02G 1/04* (2006.01)

(52) U.S. Cl.
USPC ..... 60/517; 60/520; 60/521; 60/522; 60/526

(58) Field of Classification Search
USPC ..... 60/517; 62/6; 367/7
See application file for complete search history.

(56) References Cited

U.S. PATENT DOCUMENTS

| | | | | |
|---|---|---|---|---|
| 5,275,002 | A * | 1/1994 | Inoue et al. | 62/6 |
| 5,647,216 | A * | 7/1997 | Garrett | 62/6 |
| 7,404,296 | B2 * | 7/2008 | Watanabe et al. | 62/6 |
| 2008/0110180 | A1 * | 5/2008 | Watanabe et al. | 62/6 |

FOREIGN PATENT DOCUMENTS

JP 2000-088378 A 3/2000

* cited by examiner

*Primary Examiner* — Thomas Denion
*Assistant Examiner* — Shafiq Mian
(74) *Attorney, Agent, or Firm* — Arent Fox LLP

(57) ABSTRACT

A thermoacoustic engine includes first and second stacks disposed in parallel in a looped tube and a heat storage unit disposed in the looped tube. A circuit length between a center of the first stack and a center of the heat storage unit is equal to a circuit length between a center of the second stack and the center of the heat storage unit. A first acoustic circuit including the first stack and the heat storage unit has a circuit length which is equal to a circuit length of a second acoustic circuit including the second stack and the heat storage unit.

6 Claims, 4 Drawing Sheets

THERMOACOUSTIC ENGINE

FIELD OF THE INVENTION

The present invention relates to a thermoacoustic engine including a gas-filled looped tube having a stack and a heat storage unit embedded therein for recovering heat inputted to one end of the stack by the heat storage unit via a sound wave induced by the stack and propagating to the heat storage unit.

BACKGROUND OF THE INVENTION

Thermoacoustic engines are known as a device for recovering heat (exhaust heat) of a heat source. A typical example of such known thermoacoustic engines is disclosed in Japanese Patent Application Laid-Open Publication (JP-A) No. 2000-88378. The disclosed thermoacoustic engine includes a stack and a heat storage unit that are embedded in a gas-filled looped tube, and a hot-side heat exchanger and a cold-side heat exchanger that are disposed on opposite sides of each of the stack and the heat storage unit.

In order to recover exhaust heat from a heat source, the hot-side heat exchanger associated with the stack is heated with heat supplied from the heat source, while the cold-side heat exchanger associated with the stack and the cold-side heat exchanger associated with the heat storage unit are cooled. Due to a temperature gradient created across the stack, the gas in the stack undergoes self-exited oscillation and the stack induces a sound wave. The sound wave propagates through the gas to the heat storage unit, thereby heating the hot-side heat exchanger associated with the heat storage unit. The exhaust heat of the heat source is thus recovered.

Since the thermoacoustic engine disclosed in JP 2000-88378 A has only one stack in the looped tube, the efficiency of converting heat energy (exhaust heat of the heat source) to acoustic power is relatively low.

As the heat source for the thermoacoustic engine, various exhaust heats, including engine exhaust heat and boiler exhaust heat, can be used. However, such exhaust heats are not constant in temperature. Furthermore, if the exhaust heat is near room temperature, efficient recovery of the exhaust heat by the conventional thermoacoustic engine is practically impossible.

It is an object of the present invention to provide a thermoacoustic engine which is capable of recovering heat with high efficiencies even when temperature of heat from a heat source is relatively low.

SUMMARY OF THE INVENTION

According to the present invention, there is provided a thermoacoustic engine, comprising: a looped tube filled with a gas; a plurality of stacks disposed in parallel in the looped tube; and a heat storage unit disposed in the looped tube, wherein a circuit length between a center of each one of the plurality of stacks and a center of the heat storage unit is equal to a circuit length between a center of another stack of the plurality of stacks and the center of the heat storage unit, and wherein an acoustic circuit including each one of the plurality of stack and the heat storage unit has a length which is equal to a length of an acoustic circuit including another stack of the plurality of stacks and the heat storage unit.

With the thermoacoustic engine thus arranged, a sound wave (acoustic power) induced by one stack and a sound wave (acoustic power) induced by another stack are synthesized without attenuation while the respective sound waves are propagating to the heat storage unit. The heat storage unit is thus able to recover heat with increased efficiencies. The thermoacoustic engine equipped with two or more stacks can be used in combination with a corresponding number of heat sources of different temperatures.

BRIEF DESCRIPTION OF THE DRAWINGS

Certain preferred embodiments of the present invention will be described in detail below, by way of example only, with reference to the accompanying sheets of drawings, in which.

DETAILED DESCRIPTION OF THE PREFERRED EMBODIMENTS

Figure 1:
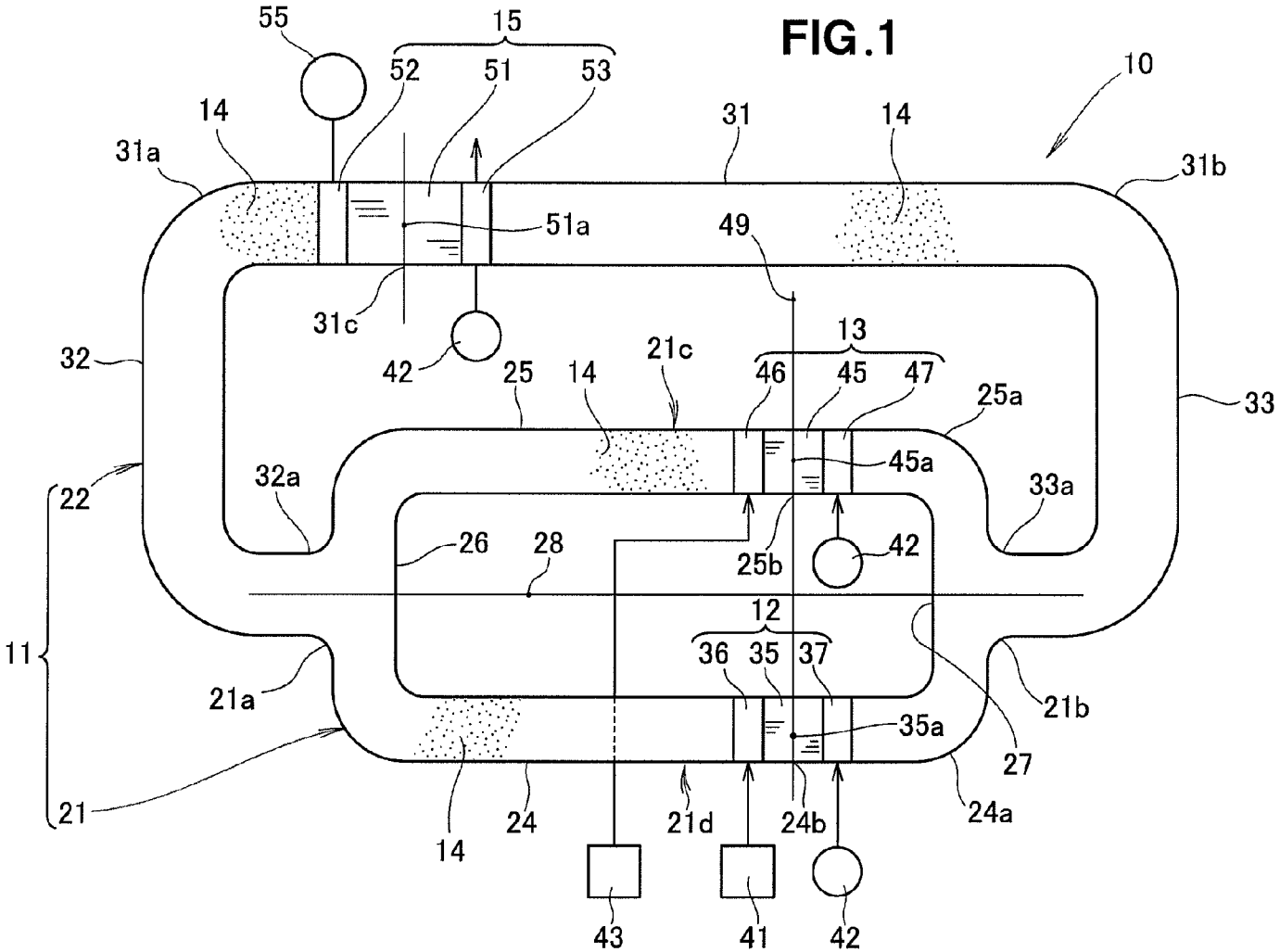
FIG. 1 is a diagrammatical view showing the general configuration of a thermoacoustic engine according to a first embodiment of the present invention.

A thermoacoustic engine according to a first embodiment of the present invention will be described below with reference to FIG. 1. As shown in this figure, the thermoacoustic engine 10 takes the form of a looped tube type thermoacoustic engine and comprises an endless or looped tube 11 filled with a gas 14, first and second thermal acoustic generators 12 and 13 disposed in parallel in the looped tube 11 and operable to induce a sound wave (acoustic oscillations of the gas) when supplied with external heat at one end thereof, and a heat storage unit 15 disposed in the looped tube 11 and adapted to be cooled or heated by the sound wave propagating from the generators 12, 13 to the heat storage unit 15.

The looped tube 11 is a circular cross-section tube made of stainless steel and filled with an inert gas, such as nitrogen, helium, argon, or a mixture of helium and argon. The looped tube 11 is comprised of a generator-side looped tube section 21 of a substantially rectangular frame-shaped configuration and a heat-storage-side looped tube section 22 connected to opposite ends 21*a* and 21*b* of the generator-side looped tube section 21.

The generator-side looped tube section 21 includes a first linear tube 24 and a second linear tube 25 extending parallel to each other and spaced a predetermined distance from each other, a first connecting tube 26 interconnecting respective first ends (left ends in FIG. 1) of the first and second linear tubes 24, 25, and a second connecting tube 27 interconnecting respective second ends (right ends in FIG. 1) 24*a*, 25*a* of the first and second linear tubes 24, 25. The first connecting tube 26 and the second connecting tube 27 are arranged in parallel with each other and spaced from each other by a predetermined distance.

The generator-side looped tube section 21 of the rectangular frame-shaped configuration has a longitudinal centerline 28 and consists of an upper tube part 21*c* and a lower tube part 21*d* that are symmetrical with respect to the centerline 28. The upper tube part 21*c* is formed by the second linear tube 25, an upper half of the first connecting tube 26, and an upper half of the second connecting tube 27. Similarly, the lower tube part 21*d* is formed by the first linear tube 24, a lower half of the first connecting tube 26, and a lower half of the second connecting tube 27. The upper and lower tube parts 21*c* and 21*d* have tube lengths that are equal to each other.

The first thermal acoustic generator 12 is disposed in the first linear tube 24 of the generator-side looped tube section 21, and the second thermal acoustic generator 13 is disposed in the second linear tube 25 of the generator-side looped tube section 21. Thus, the first and second thermal acoustic generators 12 and 13 are disposed in parallel with each other. More particularly, a first stack 35 and a second stack 45 are disposed in parallel in the generator-side looped tube section 21.

The heat-storage-side looped tube section 22 includes a linear tube 31 extending parallel to and spaced a predetermined distance from the second linear tube 25 of the generator-side looped tube section 21, a first L-shaped tube 32 connecting one end 31*a* of the linear tube 31 to a substantially middle part of the first connecting tube 26 of the generator-side looped tube section 21, and a second L-shaped tube 33 connecting an opposite end 31*b* of the linear tube 31 to a substantially middle part of the second connecting tube 27 of the generator-side looped tube section 21.

The first and second L-shaped tubes 32, 33 of the heat-storage-side looped tube section 22 are bilaterally symmetric to each other. The first L-shaped tube 32 has an end 32*a* connected to the substantially middle part of the first connecting tube 26 and lying on the longitudinal centerline 28 of the rectangular frame-shaped generator-side looped tube section 21. Similarly, the second L-shaped tube 33 has an end 33*a* connected to the substantially middle part of the second connecting tube 27 and lying on the longitudinal centerline 28 the rectangular frame-shaped generator-side looped tube section 21. The first and second L-shaped tubes 32 and 33 have tube lengths that are equal to each other.

The first thermal acoustic generator 12 is received in a first part 24*b* of the first linear tube 24 which is located closer to the second end 24*a* than the first end (not designated) of the first linear tube 24. The first thermal acoustic generator 12 includes the first stack 35 disposed in the first linear tube 24 of the lower tube part 21*d* of the generator-side looped tube section 21, a first hot-side heat exchanger 36 disposed on one end (left end in FIG. 1) of the first stack 35, and a first cold-side heat exchanger 37 disposed on an opposite end (right end FIG. 1) of the first stack 35.

More particularly, the first stack 35 is disposed in the first linear tube 24 in such a manner that a center 35*a* of the first stack 35 is located in the first part 24*b* of the first linear tube 24. The first stack 35 is composed of a multiplicity of thin plates arranged in a lattice-like structure or a honeycomb structure within the first linear tube 24 and has a number of very small parallel channels defined between the thin plates and extending in an axial direction of the first linear tube 24. The thin plates are made of stainless steel or ceramics.

The first hot-side heat exchanger 36 is composed of a multiplicity of thin plates arrayed at very small intervals. The first hot-side heat exchanger 36 is connected to a first heat source 41, such as an internal combustion engine Thus, the first hot-side heat exchanger 36 is heated to a high temperature with heat supplied from the first heat source 41.

The first cold-side heat exchanger 37 is composed of a multiplicity of thin plates arrayed at very small intervals. The first cold-side heat exchanger 37 is connected to a cooling water supply source 42. In the illustrated embodiment, the first cold-side heat exchanger 37 is cooled to a temperature of about 25° C. by cooling water supplied from the cooling water supply source 42.

Since the first hot-side heat exchanger 36 is heated to a high temperature by the first heat source 41 while the first cold-side heat exchanger 37 is cooled to about 25° C. by the cooling water, high-temperature heat is inputted via the first hot-side heat exchanger 36 to a hot-side end (left end in FIG. 1) of the first stack 35 while heat is released from a cold-side end (right end in FIG. 1) of the first stack 35 via the first cold-side heat exchanger 37. Thus, a predetermined large temperature difference is produced at opposite ends of the first stack 35, which creates a predetermined temperature gradient between the walls of each channel of the first stack 35. Due to this temperature gradient, the gas 14 in the very small parallel channels of the first stack 35 undergoes oscillations and the first stack 35 induces a sound wave. The sound wave propagates through the gas 14 to the heat storage unit 15.

The second thermal acoustic generator 13 is identical to the first thermal acoustic generator 12. More specifically, the second thermal acoustic generator 13 is received in a second part 25*b* of the second linear tube 25, which is located closer to the second end 25*a* than the first end (not designated) of the second linear tube 25. The second thermal acoustic generator 13 includes the second stack 45 disposed in the second linear tube 25 of the upper tube part 21*c* of the generator-side looped tube section 21, a second hot-side heat exchanger 46 disposed on one end (left end in FIG. 1) of the second stack 45, and a second cold-side heat exchanger 47 disposed on an opposite end (right end in FIG. 1) of the second stack 45.

More particularly, the second stack 45 is disposed in the second linear tube 25 in such a manner that a center 45*a* of the second stack 45 is located in the second part 25*b* of the second linear tube 25. The second stack 45 is composed of a multiplicity of thin plates arranged in a lattice-like structure or a honeycomb structure within the second linear tube 25 and has a number of very small parallel channels defined between the thin plates and extending in an axial direction of the second linear tube 25. The thin plates are made of stainless steel or ceramics.

The second hot-side heat exchanger 46 is composed of a multiplicity of thin plates arrayed at very small intervals. The second hot-side heat exchanger 46 is connected to a second heat source 43, such as an internal combustion engine. Thus, the second hot-side heat exchanger 46 is heated to a high temperature with heat supplied from the second heat source 43.

The second cold-side heat exchanger 47 is composed of a multiplicity of thin plates arrayed at very small intervals. The second cold-side heat exchanger 47 is connected to the cooling water supply source 42. The second cold-side heat exchanger 47 is cooled to a temperature of about 25° C. by cooling water supplied from the cooling water supply source 42.

Since the second hot-side heat exchanger 46 is heated to a high temperature by the second heat source 43 while the second cold-side heat exchanger 47 is cooled to about 25° C. by the cooling water, high-temperature heat is inputted via the second hot-side heat exchanger 46 to a hot-side end (left end in FIG. 1) of the second stack 45 while heat is released from a cold-side end (right end in FIG. 1) of the second stack 45 via the second cold-side heat exchanger 47. Thus, a predetermined large temperature difference is produced at opposite ends of the second stack 45, which creates a predetermined temperature gradient between the walls of each channel of the second stack 45. Due to this temperature gradient, the gas 14 in the very small parallel channels of the second stack 45 undergoes oscillate and the second stack 45 induces a sound wave. The sound wave propagates through the gas to the heat storage unit 15.

As previously discussed, the first and second thermal acoustic generators 35 and 45 are disposed in parallel in the looped tube 11. Furthermore, the center 35*a* of the first stack 35 of the first thermal acoustic generator 12 is located in the first part 24*b* of the first linear tube 24, and the center 45*a* of the second stack 45 of the second thermal acoustic generator 13 is located in the second part 25*b* of the second linear tube 25. The first part 24*b* of the first linear tube 24 and the second part 25*b* of the second linear tube 25 lie on a common straight line 49 extending perpendicular to the longitudinal centerline 28 of the rectangular frame-shaped generator-side looped tube section 21.

The heat storage unit 15 is received in a part 31*c* of the linear tube, which is located closer to the one end 31*a* than the opposite end 31*b* of the heat-storage-side looped tube section 22. The heat storage unit 15 includes a stack 51 disposed in the linear tube 31 of the heat-storage-side looped tube section 31, a hot-side heat exchanger 52 disposed on one end (left end in FIG. 1) of the stack 51, and a cold-side heat exchanger 53 disposed on an opposite end (right end in FIG. 1) of the stack 51.

More particularly, the stack 51 is disposed in the linear tube 31 in such a manner that a center 51*a* of the stack 51 is located in that part 31*c* of the linear tube 31 which is located closer to the one end 31*a* than the opposite end 31*b*. The stack 51 is composed of a multiplicity of thin plates arranged in a lattice-like structure or a honeycomb structure within the linear tube 31 and has a number of very small parallel channels defined between the thin plates and extending in an axial direction of the linear tube 31. The thin plates are made of stainless steel or ceramics.

The hot-side heat exchanger 52 is composed of a multiplicity of thin plates arrayed at very small intervals. The hot-side heat exchanger 52 is connected to a hot water tank 55. The hot water tank 55 is provided to recover heat which has been converted from acoustic power (pressure oscillations of gas) propagated from the first and second thermal acoustic generators 12, 13.

The cold-side heat exchanger 52 is composed of a multiplicity of thin plates arrayed at very small intervals. The cold-side heat exchanger 52 is connected to the cooling water supply source 42. The cold-side heat exchanger 52 is cooled to a temperature of about 25° C. by cooling water supplied from the cooling water supply source 42.

With this arrangement, when a sound wave (pressure oscillations of the gas 14) induced by each of the first and second thermal acoustic generators 12, 13 propagates to the heat storage unit 15 while the cold-side heat exchanger 53 is cooled to about 25° C. by the cooling water, the gas in the stack 51 undergoes oscillations at a frequency and an amplitude that are determined in accordance with those of the propagated sound wave, thereby heating the hot-side heat exchanger 52.

Figure 2A:
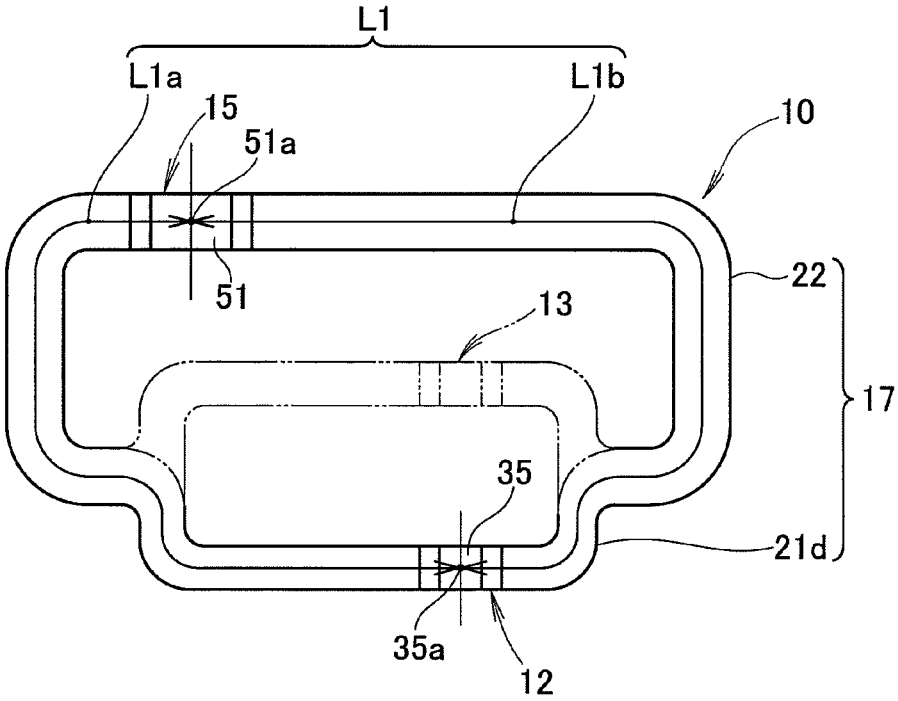
FIG. 2A is a diagrammatical view of a looped tube having a first acoustic circuit including a first thermal acoustic generator and a heat storage unit of the thermoacoustic engine.

As shown in FIG. 2A, a circuit part of the endless tube 11 extending in the clockwise direction from the center 35*a* of the first stack 35 to the center 51*a* of the stack 51 is set to have a circuit length L1*a*. Similarly, a circuit part of the endless pipe 11 extending in the counterclockwise direction from the center 35*a* of the first stack 35 to the center 51*a* of the stack 51 is set to have a circuit length L1*b*. According to the invention, the circuit length L1*a* of the clockwise circuit part is approximately equal to the circuit length L1*b* of the counterclockwise circuit part (L1*a*≈L1*b*).

Figure 2B:
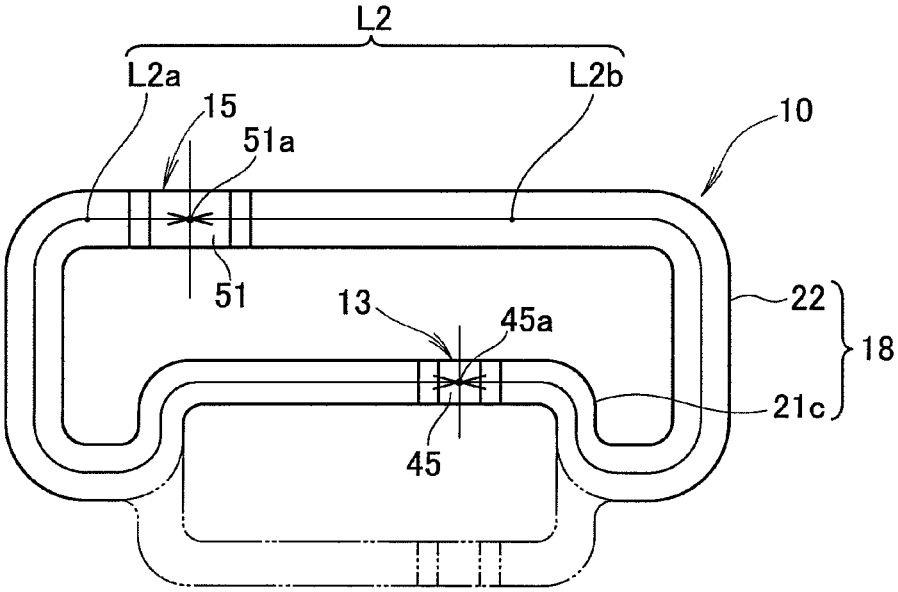
FIG. 2B is a diagrammatical view of a the looped tube having a 10 second acoustic circuit including a second thermal acoustic generator and the heat storage unit of the thermoacoustic engine.

As shown in FIG. 2B, a circuit part of the endless pipe 11 extending in the clockwise direction from the center 45*a* of the second stack 45 to the center 51*a* of the stack 51 is set to have a circuit length L2*a*. Similarly, a circuit part of the endless pipe 11 extending in the counterclockwise direction from the center 45*a* of the second stack 45 to the center 51*a* of the stack 51 is set to have a circuit length L2*b*. According to the invention, the circuit length L2*a* of the clockwise circuit part is approximately equal to the circuit length L2*b* of the counterclockwise circuit part (L2*a*≈L2*b*).

Furthermore, the circuit length L1*a* shown in FIG. 2A is equal to the circuit length L2*a* shown in FIG. 2B (L1*a*≈L2*a*). As shown in FIGS. 2A and 2B, a first acoustic circuit 17 of the endless loop 11 including the first thermal acoustic generator 12 and the heat storage unit 15 has a first acoustic circuit length L1, which is represented by the sum of the circuit length L1*a* and the circuit length L1*b*. The first acoustic circuit 17 is formed by the heat-storage-side looped tube section 22 and the lower tube part 21*d* of the generator-side looped tube section 21.

Similarly, a second acoustic circuit 18 of the looped tube 11 including the second thermal acoustic generator 13 and the heat storage unit 15 has a second acoustic circuit length L2, which is represented by the sum of the circuit length L2*a* and the circuit length L2*b*. The second acoustic circuit 18 is formed by the heat-storage-side looped tube section 22 and the upper tube part 21*c* of the generator-side looped tube section 21. The first acoustic circuit length L1 is equal to the second acoustic circuit length L2.

Referring back to FIG. 1, a description will be made about an operation of the thermoacoustic engine 10 which is performed to recover heat of the first and second heat sources 41 and 43 into the hot water tank 55. The first hot-side heat exchanger 36 of the first thermal acoustic generator 12 is heated to a high temperature with heat supplied from the first heat source 41, while the first cold-side heat exchanger 37 of the first thermal acoustic generator 12 is cooled to about 25° C. by cooling water supplied from the cooling water supply source 42. Due to a temperature gradient created across the first stack 35 of the first thermal acoustic generator 12, the gas 14 in the first stack 35 undergoes self-excited oscillations and the first stack 35 induces a sound wave, which will propagates through the gas 14 to the heat storage unit 15.

At the same time, the second hot-side heat exchanger 46 of the second thermal acoustic generator 13 is heated to a high temperature with heat supplied from the second heat source 43, while the second cold-side heat exchanger 47 of the second thermal acoustic generator 13 is cooled to about 25° C. by cooling water supplied from the cooling water supply source 42. Due to a temperature gradient created across the second stack 45 of the second thermal acoustic generator 13, the gas in the second stack 45 undergoes self-excited oscillations and the second stack 45 induces a sound wave, which will propagates through the gas 14 to the heat storage unit 15.

Here, the cold-side heat exchanger 53 of the heat storage unit 15 is cooled to about 25° C. by the cooling water supplied from the cooling water supply source 42. Due to a temperature gradient created across the stack 51 of the heat storage unit 15, the gas in the stack 51 undergoes oscillations at a frequency and amplitude which are determined according to the oscillations (sound waves) propagated from the respective stacks 35 and 45 of the first and second thermal acoustic generator 12, 13. By virtue of the oscillations of gas, heat is transferred to the hot-side heat exchanger 52, thereby increasing the temperature of the hot-side heat exchanger 52. High temperature heat of the thus heated hot-side heat exchanger 52 is recovered by the hot water tank 55.

Figure 3:
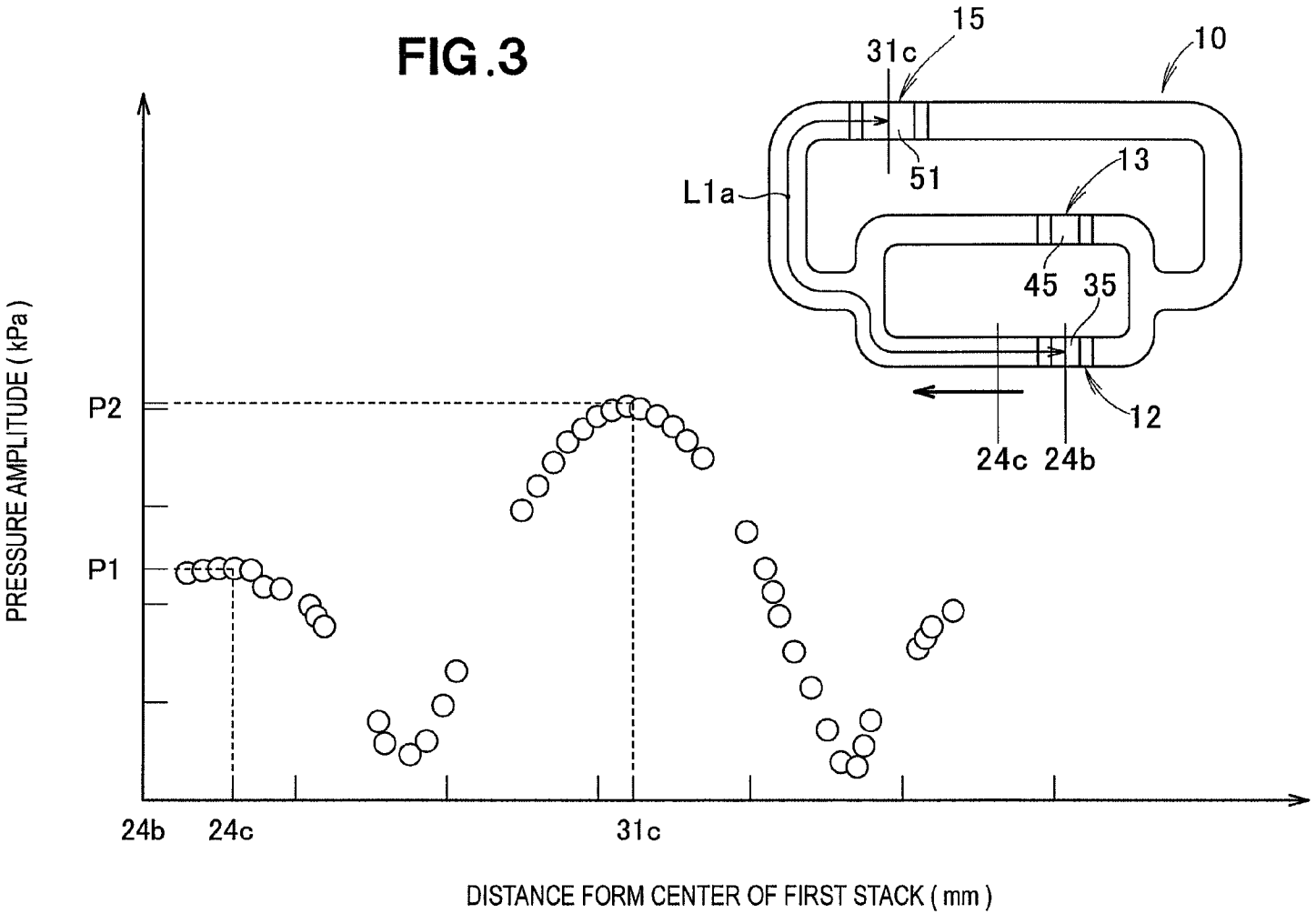
FIG. 3 is a graph showing the relation between the pressure amplitude of a sound wave propagating to the heat storage unit and the distance from the first stack.

Referring next to a graph shown in FIG. 3, a description will be made about the sound wave (pressure) propagating to the heat storage unit 15. In the graph, the vertical axis represents the pressure amplitude (kPa) of a sound wave propagating along the looped tube 11, and the horizontal axis represents the distance (mm) from the center 35*a* of the first stack 35. FIG. 3 is a graphical representation of the result of a measurement of internal pressure of the looped tube 11 obtained by using a pressure sensor (not shown). More specifically, the internal pressure of the looped tube 11 is measured by the pressure sensor while the measurement position is moved or shifted along the looped tube 11 in the clockwise direction from the first thermal acoustic generator 12.

It appears clear from the graph shown in FIG. 3 that at a part 24*c* of the looped tube 11, which is located adjacent to the first thermal acoustic generator 12, the pressure amplitude reaches an initial peak value P1; and at a part 31*c* of the looped tube 11, which is axially spaced from the first thermal acoustic generator 12 by a distance equal to the circuit length L1*a*, the pressure amplitude reaches a maximum peak value P2.

The part 24*c* of the looped tube 11 is located in the first linear tube 24 of the generator-side looped tube section 21. Since the first linear tube 24 and the second linear tube 25 are parallel spaced from each other, the synthesis of a sound wave propagating from the first thermal acoustic generator 12 and a sound wave propagating from the second thermal acoustic generator 13 does not take place at the part 24*c*. The initial peak value P1 appearing at this part 24*c* of the first linear tube 24 is relatively small because it is produced solely by a sound wave induced by the first thermal acoustic generator 12.

On the other hand, the part 31*c* of the looped tube 11, which is axially spaced from the first thermal acoustic generator 12 by the circuit length L1*a*, is located in the linear tube 31 of the heat-storage-side looped tube section 22. As previously discussed, the circuit length L1*a* is equal to the circuit length L2*a* (FIG. 2B), and the first acoustic circuit length L1 (FIG. 2A) is equal to the second acoustic circuit length L2 (FIG. 2B). Thus, the part 31*c* of the looped tube 11 which is axially spaced from the first thermal acoustic generator 12 by the circuit length L1 serves as a sound-wave synthesis tube part where a sound wave induced by the first thermal acoustic generator 12 and a sound wave induced from the second thermal acoustic generator 13 are synthesized without attenuation. By virtue of the sound wave synthesis, the maximum peak value P2, which is obtained at the tube part 31*c* axially spaced from the first thermal acoustic generator 12 by the circuit length L1*a*, is considerably greater than the initial peak value P1.

As thus far described, the thermoacoustic engine 10 according to the first embodiment of the present invention includes a first thermal acoustic generator 12 and a second thermal acoustic generator 13 that are disposed in parallel in a gas-filled looped tube 11. The thermoacoustic engine 10 provided with the first and second thermal acoustic generators 12, 13 is compatible with heat sources of different temperatures, where heat from a first heat source 41 is inputted to the first thermal acoustic generator, and heat from a second heat source 43 is inputted to the second thermal acoustic generator 13.

With this arrangement, the heat supplied from the first heat source 41 is converted by the first thermal acoustic generator 12 into a sound wave, and the heat supplied from the second heat source 43 is converted by the second thermal acoustic generator 13 into a sound wave. Thus, heat from the first heat source 41 and heat from the second heat source 43 are supplied separately to the first and second thermal acoustic generators 12 and 13, and the supplied heats are individually converted into two separate sour waves by the first and second thermal acoustic generators 12 and 13.

As previously discussed, the circuit length L1*a* (FIG. 2A) is equal to the circuit length L2*a* (FIG. 2B), and the first acoustic circuit length L1 (FIG. 2A) is equal to the second acoustic circuit length L2 (FIG. 2B). With this arrangement, a sound wave induced by the first thermal acoustic generator 12 and a sound wave induced by the second thermal acoustic generator 13 are synthesized without attenuation while they are propagating to the heat storage unit 15. By virtue of the sound wave synthesis, heats from the first and second heart sources 41, 42 can be recovered efficiently and reliably by the heat storage unit 15 of the thermoacoustic engine 10.

Next, a thermoacoustic engine 60 according to a second embodiment of the present invention will be described below with reference to FIG. 4. In the thermoacoustic engine 60, these parts which are identical or similar to those described above with respect to the thermoacoustic engine 10 are designated by the same reference characters and a further description can be omitted.

Figure 4:
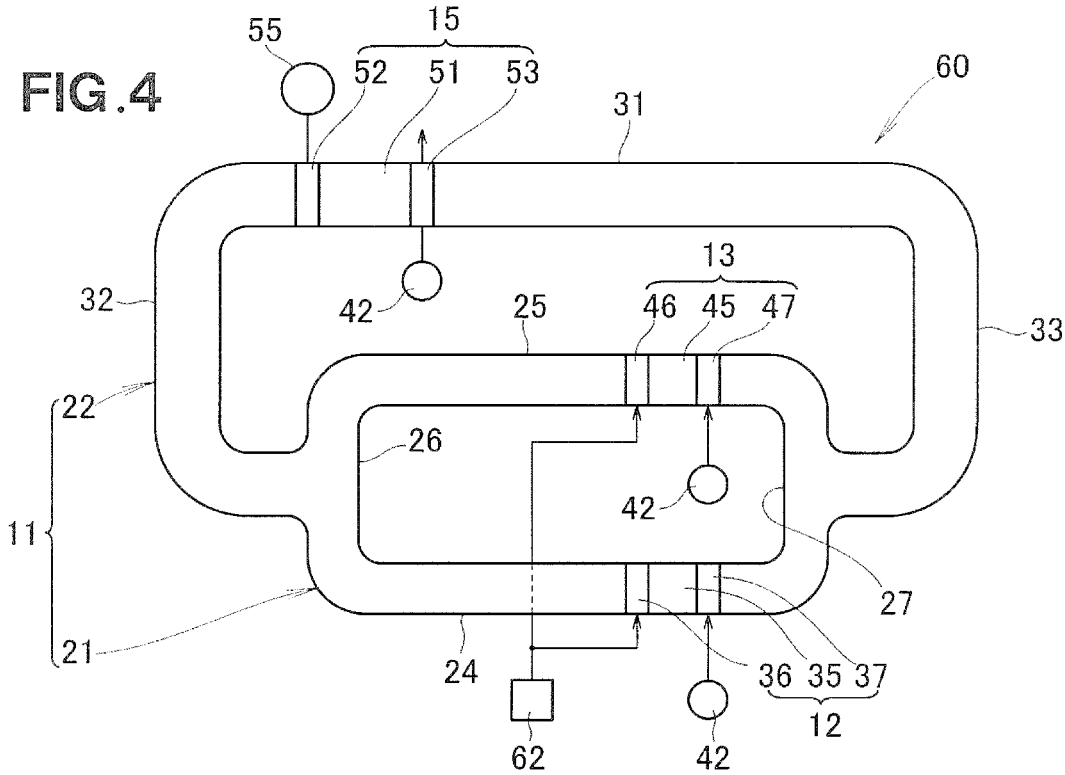
FIG. 4 is a diagrammatical view showing the general configuration of a thermoacoustic engine according to a second embodiment of the present invention.

As shown in FIG. 4, the thermoacoustic engine 60 is structurally the same as the thermoacoustic engine 10 of the first embodiment but differs therefrom in that a single heat source 62 such as an internal combustion engine is used in place of the two heat sources 41 and 43. The heat source 62 is connected to a first hot-side heat exchanger 36 and a second hot-side heat exchanger 46. The first hot-side heat exchanger 36 is heated to a high temperature by heat supplied from the heat source 62. Similarly, the second hot-side heat exchanger 46 is heated to the high temperature by heat supplied from the heat source 62.

As a plurality of thermal acoustic generators, first and second thermal acoustic generators 12 and 13 are disposed in a gas-filed looped tube 11 of the thermoacoustic engine 60. The first and second thermal acoustic generators 12 and 13 are arranged in parallel spaced relation to each other. Both of the first and second thermal acoustic generators 12 and 13 are supplied with heat from the heat source 62. This arrangement is advantageous in that when, for some reason, one thermal acoustic generator (the first thermal acoustic generator 12, for example) fails to convert heat from the heat source 62 into a sound wave, the heat from the heat source 62 can be used and converted into a sound wave by the other thermal acoustic generator (the second thermal acoustic generator 13, for example). Thus, the conversion of heat from the heat source 62 to a sound wave (acoustic power) can be achieved reliably and efficiently.

Though not shown in FIG. 4 but also in case of the thermoacoustic engine 60, a circuit part of the looped tube 11 extending in the clockwise direction from the center of a first stack 35 of the first thermal acoustic generator 12 to the center of a stack 51 of the heat storage unit 15 has a circuit length Ma, which is equal to a circuit length L2*a* of a circuit part of the looped tube 11 extending in the clockwise direction from the center of a second stack 45 of the second thermal acoustic generator 13 to the center of the stack 51 of the heat storage unit 15. Furthermore, a first acoustic circuit of the looped tube 11 including the first thermal acoustic generator 12 and the heat storage unit 15 has a first acoustic circuit length L1, which is equal to a second acoustic circuit length L2 of a second acoustic circuit of the looped tube 11 including the second thermal acoustic generator 13 and the heat storage unit 15. With this arrangement, a sound wave induced by the first thermal acoustic generator 12 and a sound wave induced by the second thermal acoustic generator 13 are synthesized without attenuation while they are propagating to the heat storage unit 15. By virtue of the sound wave synthesis, heats from the heart source 62 can be recovered efficiently and reliably by the heat storage unit 15 of the thermoacoustic engine 60.

Certain preferred structural embodiments of the present invention have been disclosed and described in conjunction with the thermoacoustic engines 10 and 60. The present invention should by no means be limited to the illustrated embodiments but various minor changes and modifications are possible in the light of the above teaching. For instance, the number of the stacks disposed in the gas-filled looped tube 11 is not limited to two as in the illustrated embodiments, but three or more stacks arranges in parallel to one another can be used. Furthermore, as for parts of the thermoacoustic engines 10, 60 including the looped tube 11, first and second thermal acoustic generators 12, 13, heat storage unit 15, and first and second stacks 35, 45, the shape and configuration is not limited to the one shown in the illustrated embodiment but may be changed where appropriate. It is to be understood that within the scope of the appended claims the present invention may be practiced otherwise than as specifically described.

What is claimed is:

1. A thermoacoustic engine, comprising:

a looped tube filled with a gas;

a first stack and a second stack disposed in parallel in the looped tube; and a heat storage unit disposed in the looped tube, the heat storage unit having hot and cold side heat exchangers, wherein a first acoustic circuit is defined by a portion of the tube extending from a center of the heat storage unit, around the hot side heat exchanger of the heat storage unit, around a center of one of the first stack and the second stack, and around the cold side heat exchanger of the heat storage unit, wherein a second acoustic circuit is defined by a portion of the tube extending from the center of the heat storage unit, around the hot side heat exchanger of the heat storage unit, around a center of the other one of the first stack and the second stack, and around the cold side heat exchanger of the heat storage unit, wherein a circuit length between the center of the first stack and the center of the heat storage unit is equal to a circuit length between a center of the second stack and the center of the heat storage unit, and wherein the first acoustic circuit has a length which is equal to a length of the second acoustic circuit.

2. The thermoacoustic engine according to claim 1, wherein the first stack comprises a first stack element disposed between a hot side heat exchanger and a cold side heat exchanger.

3. The thermoacoustic engine according to claim 2, wherein the first stack element comprises a plurality of plates and plurality of parallel channels, wherein the plurality of parallel channels are defined between the plates and extend in an axial direction.

4. The thermoacoustic engine according to claim 2, wherein the second stack comprises a second stack element disposed between a hot side heat exchanger and a cold side heat exchanger.

5. The thermoacoustic engine according to claim 4, wherein the second stack element comprises a plurality of plates and plurality of parallel channels, wherein the plurality of parallel channels are defined between the plates and extend in an axial direction.

6. The thermoacoustic engine according to claim 1, wherein the heat storage unit comprises a stack element having a plurality of plates and plurality of parallel channels, wherein the plurality of parallel channels are defined between the plates and extend in an axial direction.

* * * * *